US009742091B2

(12) United States Patent
Martin et al.

(10) Patent No.: US 9,742,091 B2
(45) Date of Patent: Aug. 22, 2017

(54) METHOD AND STRUCTURE FOR CONDUCTIVE ELASTOMERIC PIN ARRAYS USING SOLDER INTERCONNECTS AND A NON-CONDUCTIVE MEDIUM

(71) Applicant: R&D Sockets, Inc., Mineola, NY (US)

(72) Inventors: Charles William Martin, Wind Gap, PA (US); James V. Russell, New Hope, PA (US); Thomas P. Warwick, Melbourne, PA (US); Demick McMullin, Catasauqua, PA (US); William Quick, Belleville, NJ (US)

(73) Assignee: R&D Sockets, Inc., Allentown, PA (US)

( * ) Notice: Subject to any disclaimer, the term of this patent is extended or adjusted under 35 U.S.C. 154(b) by 0 days.

(21) Appl. No.: 14/533,406

(22) Filed: Nov. 5, 2014

(65) Prior Publication Data

US 2015/0295337 A1 Oct. 15, 2015

Related U.S. Application Data

(63) Continuation-in-part of application No. 61/978,280, filed on Apr. 11, 2014.

(51) Int. Cl.

| | |
|---|---|
| ***H01R 12/00*** | (2006.01) |
| ***H01R 13/24*** | (2006.01) |
| ***H01R 43/00*** | (2006.01) |
| *H01R 12/70* | (2011.01) |
| *H01R 12/71* | (2011.01) |

(52) U.S. Cl.

CPC ..... *H01R 13/2414* (2013.01); *H01R 43/007* (2013.01); *H01R 12/7082* (2013.01); *H01R 12/714* (2013.01)

(58) Field of Classification Search

CPC .... H01R 9/096; H01R 13/2435; H01R 12/52; H01R 13/2414

USPC ..... 439/66, 91, 591

See application file for complete search history.

(56) References Cited

U.S. PATENT DOCUMENTS

| | | | | |
|---|---|---|---|---|
| 6,062,873 | A * | 5/2000 | Kato | G01R 1/0408 439/66 |
| 7,726,984 | B2 * | 6/2010 | Bumb, Jr. | H01R 4/26 439/591 |
| 9,049,789 | B2 * | 6/2015 | Ohsawa | H05K 1/0296 |
| 2007/0281516 | A1 * | 12/2007 | Yamada | G01R 1/0735 439/91 |
| 2009/0230975 | A1 * | 9/2009 | Yamada | G01R 1/0735 324/537 |

(Continued)

*Primary Examiner* — Abdullah Riyami
*Assistant Examiner* — Thang Nguyen
(74) *Attorney, Agent, or Firm* — Richard B Klar, Esq.; Law Office of Richard B. Klar

(57) ABSTRACT

A method and structure is provided for constructing elastomeric pin arrays using solder interconnects and a non-conductive medium. Pin to pin interconnects are constructed using a solder connection through a non-conductive medium. This structure eliminates the need for PCB structures as the medium, reducing manufacturing cost. In another embodiment one or more elastomeric columns extend through holes or openings in the non conductive medium. The elastomeric columns are fixed securely within the holes preferably with adhesive material. Compression stops are provided on both sides of each elastomeric column for both the upper and bottom surfaces of the non conductive medium.

8 Claims, 4 Drawing Sheets

(56) References Cited

U.S. PATENT DOCUMENTS

| | | | | |
|---|---|---|---|---|
| 2011/0223780 | A1* | 9/2011 | Russell | H01R 12/57 439/66 |
| 2012/0202364 | A1* | 8/2012 | Rathburn | H05K 3/32 439/91 |
| 2015/0027749 | A1* | 1/2015 | Warwick | H01R 11/18 174/135 |

* cited by examiner

METHOD AND STRUCTURE FOR CONDUCTIVE ELASTOMERIC PIN ARRAYS USING SOLDER INTERCONNECTS AND A NON-CONDUCTIVE MEDIUM

RELATED APPLICATIONS

The present application is a non provisional application of provisional application Ser. 61/978,280 filed by Charles Martin, et al. on Apr. 30, 2014.

BACKGROUND

1. Field

The present invention relates to a method and structure for improving conductive elastomeric interposer manufacture. In particular, the present invention provides a structure of an elastomeric interposer without a PCB (Printed Circuit Board) substrate and a method for constructing the same.

2. The Related Art

Typically PCB structures are required as mediums when structuring interconnects. It would be desirable to eliminate the need for PCB structures as mediums thereby reducing manufacturing costs. The present invention accomplishes this by using pin to pin or pin structure interconnects using a solder connection through a non-conductive medium. In this way an elastomeric structure is constructed without a PCB substrate. The conductive elastomer pins that are soldered together through one or more holes or openings in the non-conductive medium. This structure forms the electrical interconnect and eliminates the need for a PCB substrate based through via/pad structure.

SUMMARY

It would be desirable to provide a method and structure for improving conductive elastomer interposer manufacture. This is accomplished by providing a method and structure for constructing conductive elastomer arrays using a non-conductive medium and solder interconnects.

DETAILED DESCRIPTION OF THE PREFERRED EMBODIMENT(S)

Figure 1:
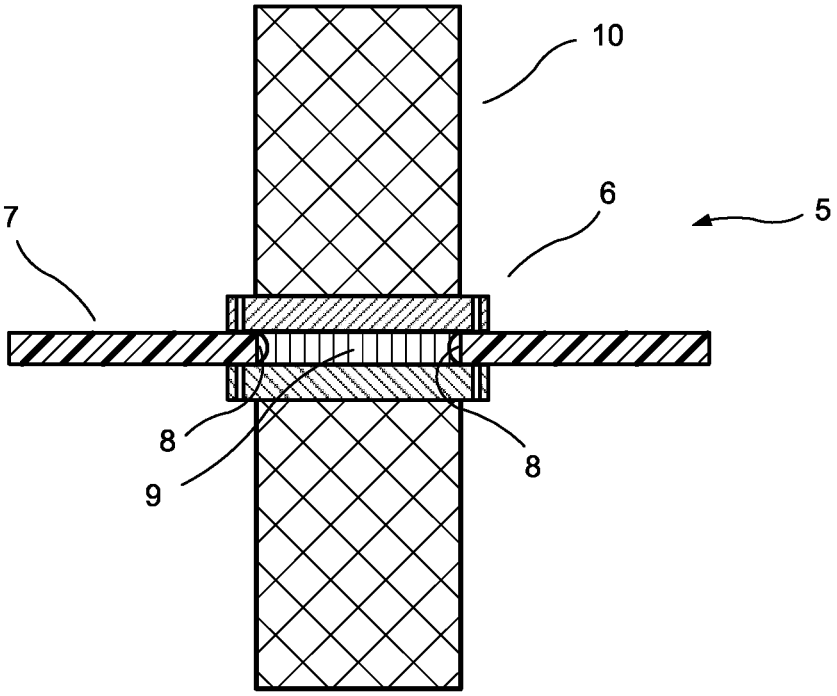
FIG. 1 is a sectional view of the present invention.

This application references applicant's pending application Ser. No. 13/815,737 filed on Mar. 15, 2013 and incorporates the subject matter in its entirety therein by reference thereto. Referring now to FIG. 1 of the drawings, FIG. 1 shows a sectional view of the present invention in which an electrical interconnect 5 is formed with a conductive elastomer 10. The conductive elastomer 10 pin metallic disc 6 connecting the conductive elastomer 10 through one or more holes open in the non-conductive medium to form an electrical interconnect. The elastomer 10 can be fixedly placed on the disc 6 by curing where the elastomer in an uncured state formed on the disc then solidifies through the curing process. Alternatively the discs 6 can have additional small holes or crevices or nodules or protrusions for the cured elastomer to take root in or around and hold in place when it solidifies. The discs 6 are located on a non-conductive medium 7 which has one or more holes or openings 8. The non-conductive medium can be any commercially available material such as but not limited to Kapton material or FR 4—fire retardant material. A solder interconnect 9 is provided in the one or more holes or openings 8 of the non-conductive medium to solder the metallic discs 6 in place thus forming the electrical interconnect 5. This structure eliminates the need for a printed circuit board (PCB) based through a via/pad structure and is therefore also more cost effective from a manufacturing perspective.

Figure 2:
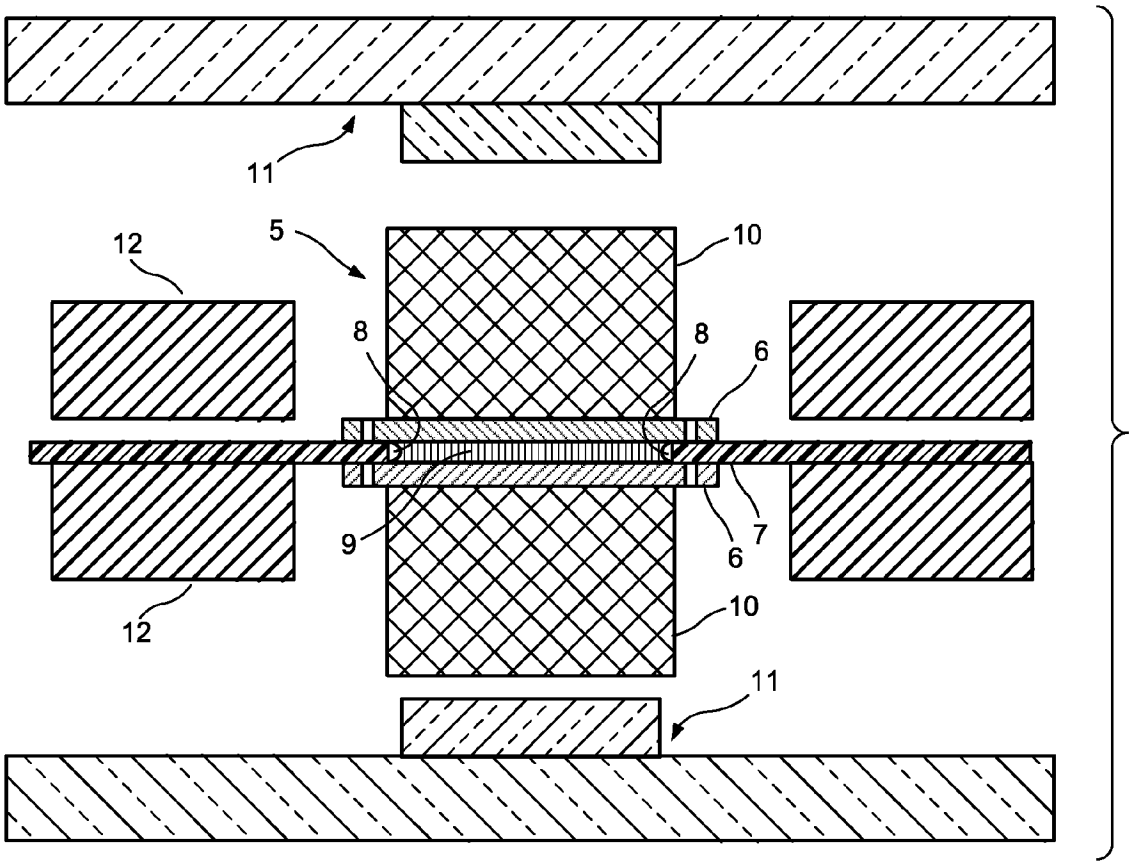
FIG. 2 is a sectional view of the present invention showing the elastomeric pin connections on both sides of the interconnect and circuit or components connected on either side of the interconnect with optional compression stops.

FIG. 2 shows the conductive elastomeric pins 10 on each side of the electrical interconnect 5 of the present invention. Each pin 10 is fixedly or securely placed on a respective surface of a metallic substrate 6 such as a metallic disc 6. The disc 6 are located on non-conductive medium 7 having one or more holes or openings 8. Solder interconnect 9 is placed within the one or more holes or openings 8 to form the electrical interconnect 5. Circuits or components on each side of the electrical interconnect 5 can be connected to the electrical interconnect 5 with optional compression stops 12.

Figure 3:
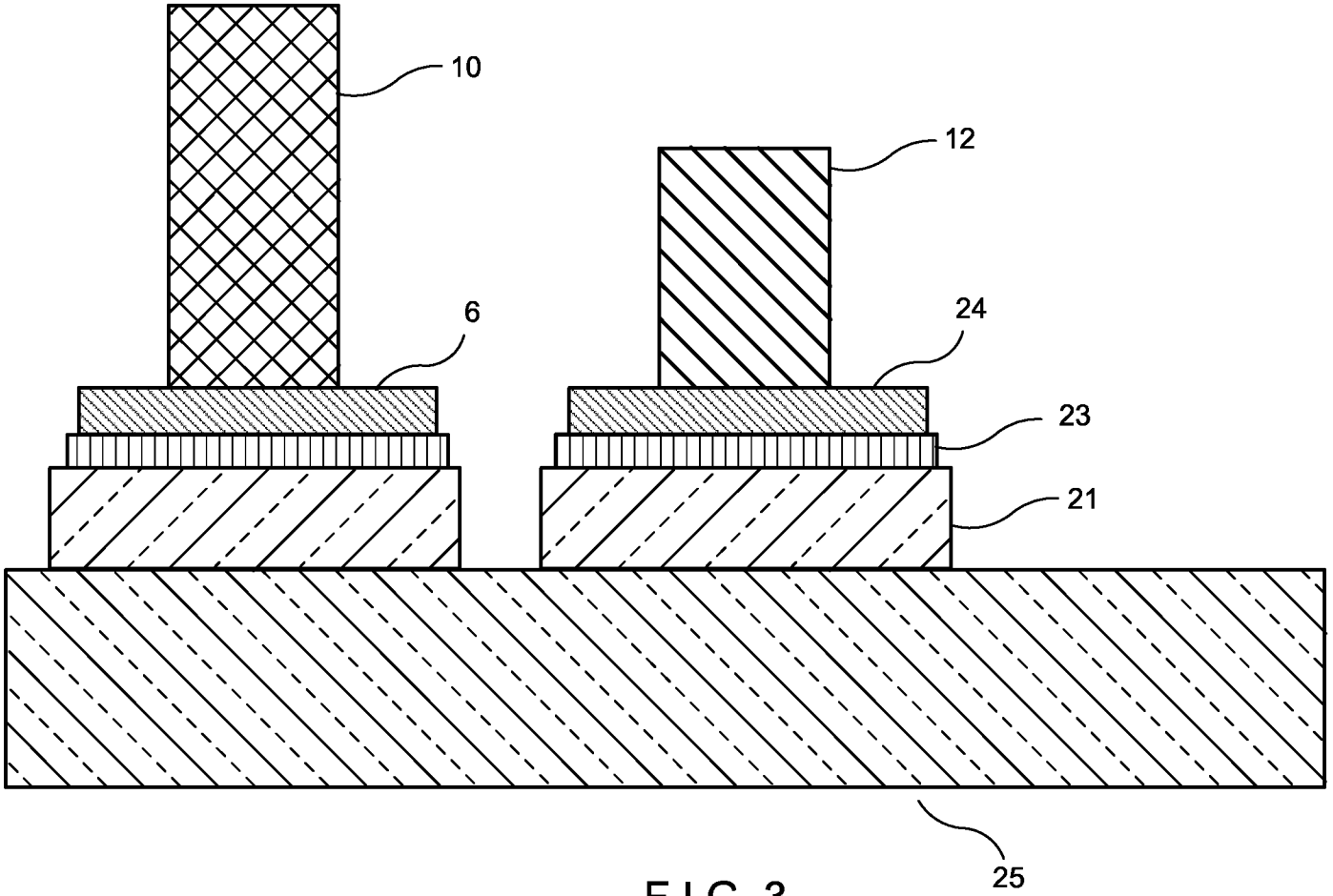
FIG. 3 is another embodiment of the present invention in which a metal disk is formed with a post or column formed on one side to a specific height to restrict compression of adjacent compliant electrical interconnects such as spring pins or conductive elastomeric pins and the individual compression stop pin may be picked and placed onto metal pads or dielectric surfaces of printed circuit boards or other electrical interconnect substrates through hand placement or by automation.

FIG. 3 is another embodiment of the present invention which replaces the need for a sheet compression stop in a compliant electrical interconnect structure. A metal disc 6 is formed with a post or column 10 formed on one side to a specific height to restrict or limit the compression of adjacent compliant electrical interconnects such as spring pins or conductive elastomeric pins 10. This individual compression stop pin 12 may be picked and placed onto metal pads or dielectric surfaces of printed circuit boards 21 or other electrical interconnect substrates through hand placement or by automation. The pin 21 can be soldered 23 to metallic pads 24 on such substrates, glued or adhered with adhesive to pads or dielectric surfaces. This embodiment of the present invention saves time and money though material savings as well as provides for ease of placement of the pin where required and the ability to place only a limited number of pins where required as opposed to sheet compression stops that cover an entire area of the array of pins.

Figure 4:
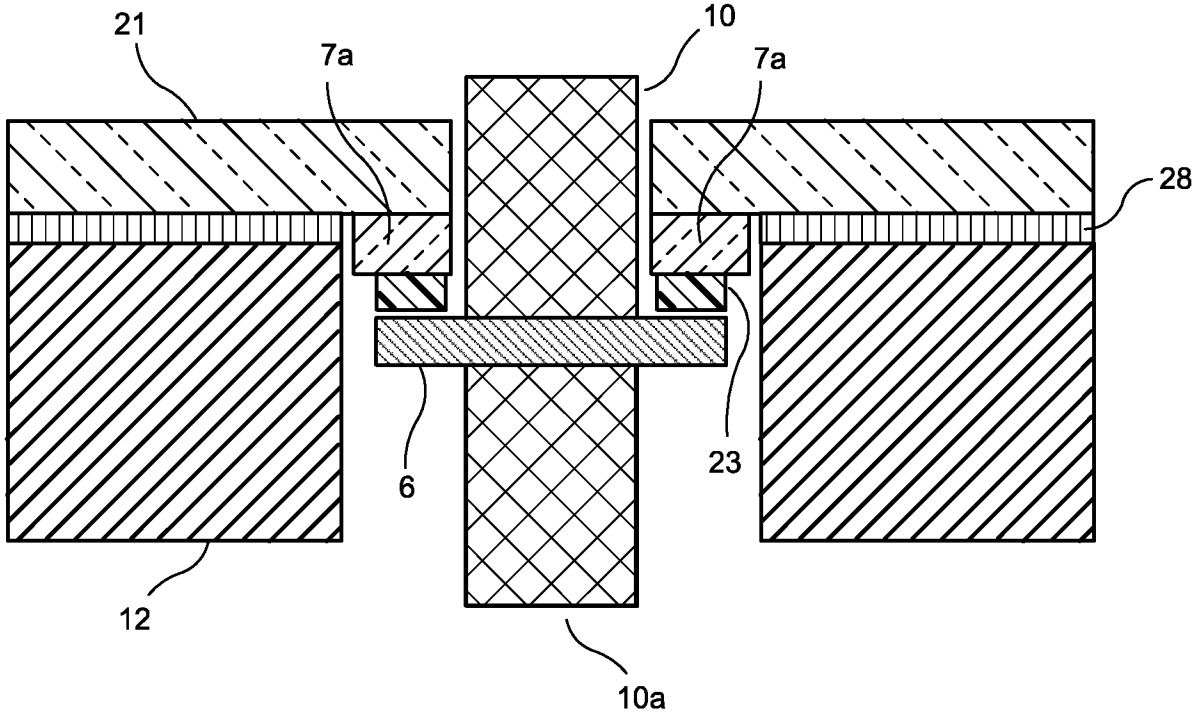
FIG. 4 is another embodiment of the present invention with one or more elastomeric columns extending through holes or openings in said nonconductive medium and being fixedly secured within said holes and with compression stops being provided on both sides of each elastomeric column for both the upper and bottom surfaces of the non conductive medium.

FIG. 4 is another embodiment of the present invention. In FIG. 4 one or more elastomeric columns 10 extend through holes or openings in the nonconductive medium. The elastomeric columns are fixed securely within said holes, preferably with adhesive material. Compression stops 12 are provide on both sides of each elastomeric column 10. The non conductive medium 7 can be made as a non conductive sheet of material 7. The compression stops 12 serve to limit the compression of the height of the elastomeric columns 10. The compression stops 12 preferably have a width of approximately 50 percent of the height of said one or more elastomers so as to limit compression of said elastomers to 40 to 50 percent.

While certain embodiments have been shown and described, it is distinctly understood that the invention is not limited thereto but may be otherwise embodied within the scope of the appended claims.

What is claimed:

1. An electrical interconnect, comprising:

an conductive elastomer which incorporates a solderable metallic disc said metallic disc being located on a non-conductive medium having one or more holes or openings therein; and said one or more holes or openings having a solder interconnect within to solder said electronically conductive pin to a second said conductive pin fixedly placed on the opposite surface of said non-conductive medium to form said electrical interconnect thereby eliminating the need for a printed circuit board (PCB) based through a via/pad structure and being more cost effective from a manufacturing perspective.

2. The electrical interconnect according to claim 1 wherein said electrical interconnect can be connected to an electrical circuit or a component.

3. The electrical interconnect according to claim 1 wherein said conductive elastomer is fixedly placed onto said metallic disc by curing said elastomer and allowing said elastomer to solidify onto said metallic disc.

4. The electrical interconnect according to claim 1 wherein said non-conductive medium is made of Kapton material or FR4 material.

5. A method for constructing an electrical interconnect, the steps comprising:

fixedly placing an electrically conductive elastomer pin on a non-conductive medium having one or more holes or an opening therein; and filling said one or more holes or opening with a solder interconnect to solder interconnect to solder electrically conductive elastomeric pin to said non-conductive medium to form said electrical interconnect thereby eliminating the need for a printed circuit board (PCB) based through a via/pad structure and being more cost effective from a manufacturing perspective.

6. The method according to claim 5 further comprising the step of connecting said electrical interconnect to an electrical circuit of a component.

7. The method according to claim 5 wherein said electrical interconnect can be connected to an electrical circuit or a component.

8. The method according to claim 5 wherein said elastomer pin includes a metallic disc, said metallic disc has crevices, holes nodules or protrusions into or around which said conducitve elastomer partially flows during and then solidifies within or around to firmly place said elastomer onto said disk.

* * * * *